US008751158B2

(12) United States Patent
Kamio et al.

(10) Patent No.: US 8,751,158 B2
(45) Date of Patent: Jun. 10, 2014

(54) PERSONAL WATERCRAFT

(75) Inventors: Kunihiko Kamio, Kobe (JP); Minoru Kanamori, Rowland Heights, CA (US); Atsufumi Ozaki, Kobe (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 871 days.

(21) Appl. No.: 12/324,748

(22) Filed: Nov. 26, 2008

(65) Prior Publication Data

US 2010/0131131 A1 May 27, 2010

(51) Int. Cl.
*B63H 21/21* (2006.01)
*B63B 17/00* (2006.01)

(52) U.S. Cl.
USPC ..... 701/444; 701/21

(58) Field of Classification Search
USPC ..... 701/21, 213, 444, 468, 491, 541; 224/406, 408, 410, 274, 401, 413; 114/55.5–55.58
See application file for complete search history.

(56) References Cited

U.S. PATENT DOCUMENTS 4,687,072 A * 8/1987 Komuro ..... 180/219
6,125,782 A * 10/2000 Takashima et al. ..... 114/343
6,157,890 A * 12/2000 Nakai et al. ..... 701/408
6,249,744 B1 * 6/2001 Morita ..... 701/213
6,339,397 B1 * 1/2002 Baker ..... 342/357.64
6,483,467 B2 * 11/2002 Kushida et al. ..... 343/713
6,484,836 B2 * 11/2002 Tsuji ..... 180/90
6,581,709 B2 * 6/2003 Tsuji ..... 180/90
6,755,145 B2 * 6/2004 Bolebruch ..... 114/347
6,876,924 B2 * 4/2005 Morita et al. ..... 701/211
7,131,876 B2 * 11/2006 Hattori et al. ..... 440/1
7,162,366 B2 * 1/2007 Takahashi ..... 701/213
7,186,154 B2 * 3/2007 Takashima et al. ..... 440/1
7,209,830 B2 * 4/2007 Takahashi ..... 701/213
7,596,448 B2 * 9/2009 Suzuki et al. ..... 701/444
8,041,507 B2 * 10/2011 Ieda et al. ..... 701/213
2001/0048212 A1 * 12/2001 Tsuji ..... 280/288.4
2002/0003501 A1 * 1/2002 Kushida et al. ..... 343/721
2002/0166493 A1 * 11/2002 Sorensen ..... 114/343
2002/0177949 A1 * 11/2002 Katayama et al. ..... 701/211
2003/0046000 A1 * 3/2003 Morita et al. ..... 701/211
2003/0066474 A1 * 4/2003 Nakajima et al. ..... 114/343
2003/0089291 A1 * 5/2003 Kanno et al. ..... 114/144 A
2004/0262350 A1 * 12/2004 Batchelor ..... 224/413
2005/0208844 A1 * 9/2005 Hattori et al. ..... 440/1
2006/0229811 A1 * 10/2006 Herman et al. ..... 701/213
2007/0171315 A1 * 7/2007 Aoyama ..... 348/836
2009/0107379 A1 * 4/2009 Duquette et al. ..... 114/55.57
2009/0107380 A1 * 4/2009 Duquette et al. ..... 114/55.57
2010/0121570 A1 * 5/2010 Tokue et al. ..... 701/208
2011/0233251 A1 * 9/2011 Doig ..... 224/567
2012/0067264 A1 * 3/2012 Aoyama ..... 114/55.5

* cited by examiner

*Primary Examiner* — Jason Holloway
(74) *Attorney, Agent, or Firm* — Alleman Hall McCoy Russell & Tuttle LLP

(57) ABSTRACT

A personal watercraft includes a handle having a pair of right and left grip portions, and a handle pad configured to cover a region of the handle, the region being located between the pair of grip portions. The handle pad is provided on a surface thereof with an accommodating concave portion configured to accommodate therein a portable information device.

9 Claims, 13 Drawing Sheets

PERSONAL WATERCRAFT

TECHNICAL FIELD

The present invention relates to a personal watercraft which is configured to eject a water jet by an engine driving power to generate a propulsion force for propelling a body of the watercraft.

BACKGROUND ART

In recent years, jet-propulsion personal watercrafts (PWC) have been widely used in leisure, sport, rescue activities, and the like. Typically, the personal watercraft is equipped with an engine mounted in an inner space defined by a hull and a deck, and a water jet pump that pressurizes and accelerates water sucked from a water intake generally provided on a hull bottom surface and ejects it rearward from an outlet port, thereby propelling a body of the personal watercraft.

There has been proposed a personal watercraft including a GPS (global positioning system) to enable a rider to correctly detect a location of the rider when the rider is planing over a wide area on the sea. U.S. Pat. No. 6,125,782 discloses a watercraft in which GPS antennae are installed separately from a GPS main system. To be specific, the GPS antennae are attached to a cushioning handle pad capable of absorbing a shock generated when, for example, the rider bumps against the handle pad during driving, an upper surface of a center storage cover, and others. A control unit and a display unit forming the GPS main system are integrated into a speed meter positioned in front of the handle pad.

In the watercraft disclosed in the above U.S. patent, however, since the GPS antennae are installed on the upper surface of the handle pad, the handle pad is incapable of effectively serving as a shock absorbing member, and the antennae tend to obstruct a view of the rider during driving of the watercraft. In addition, since the GPS antennae and the GPS main system are installed in the watercraft, the GPS cannot be utilized in situations other than driving of the watercraft. Furthermore, since the GPS antennae and the GPS main system are installed separately on the watercraft, the number of components and manufacturing cost is increased.

SUMMARY OF THE INVENTION

According to the present invention, there is provided a personal watercraft comprising a handle having a pair of right and left grip portions; and a handle pad configured to cover a region of the handle, the region being located between the pair of grip portions; wherein the handle pad is provided on a surface thereof with an accommodating concave portion configured to accommodate therein a portable information device.

In such a configuration, since the portable information device is accommodated into the accommodating concave portion of the handle pad such that the portable information device is disposed inside the concave portion and does not protrude outside therefrom, the shock generated when, for example, the rider bumps against the handle pad is effectively absorbed by the handle pad and the rider can enjoy driving without being disturbed by the portable information device. In addition, since the portable information device is detachably attachable to the accommodating concave portion, it can be utilized in situations other than driving of the watercraft. Furthermore, since the portable information device owned by the user is attached to the accommodating concave portion during use of the watercraft, it is not necessary to equip an information device in the watercraft. Therefore, the number of components and a manufacturing cost can be reduced.

The above and further objects and features of the invention will more fully be apparent from the following detailed description with accompanying drawings.

DETAILED DESCRIPTION OF THE PREFERRED EMBODIMENTS

Hereinafter, embodiments of the present invention will be described with reference to the accompanying drawings. Hereinbelow, the directions are referenced from a rider (not shown) riding in a personal watercraft except for cases specifically illustrated.

(Embodiment 1)

Figure 1:
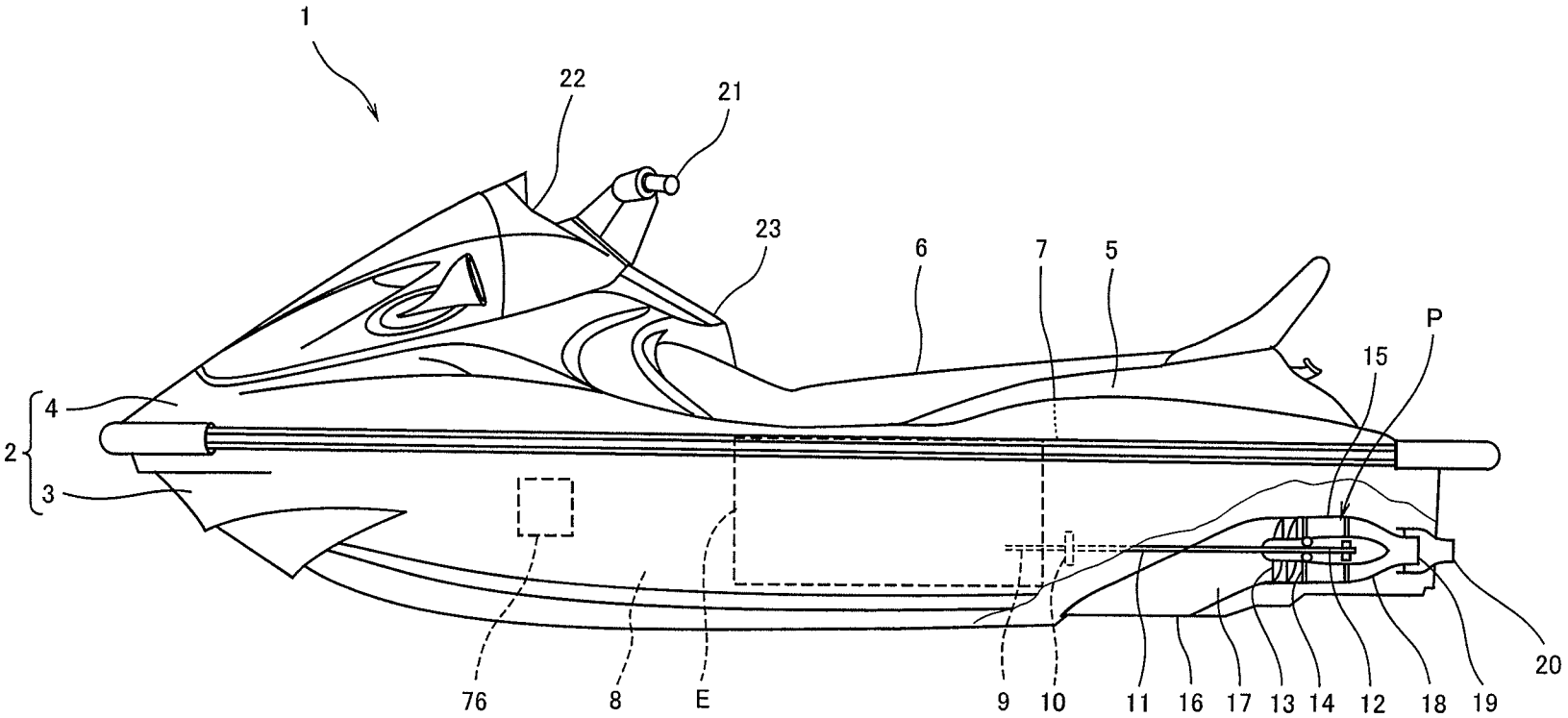
FIG. 1 is a left side view of a personal watercraft according to a first embodiment of the present invention.

FIG. 1 is a left side view of a personal watercraft 1 according to a first embodiment of the present invention. Turning now to FIG. 1, the personal watercraft 1 is a straddle-type jet-propulsion personal watercraft which is provided with a seat 6 straddled by the rider. A body 2 of the watercraft 1 includes a hull 3 and a deck 4 covering the hull 3 from above. A center section in a width direction protrudes upward at a rear part of the deck 4 to form a protruding portion 5. The seat 6 is mounted over an upper surface of the protruding portion 5. A deck floor 7 is formed at both sides in the width direction of the protruding portion 5 to be substantially flat and lower than the protruding portion 5 to enable the rider to put feet thereon.

In an inner space 8 defined by the hull 3 and the deck 4 below the seat 6, an engine E and an electronic control unit (e.g., ECU) 76 configured to control the engine E are accommodated. A crankshaft 9 of the engine E extends along the longitudinal direction of the body 2. An output end portion of the crankshaft 9 is coupled to a propeller shaft 11 via a coupling device 10. The propeller shaft 11 is coupled to a pump shaft 12 of a water jet pump P disposed at a rear portion of the body 2. The propeller shaft 11 and the pump shaft 12 rotate in association with the rotation of the crankshaft 9. An impeller 13 is attached on the pump shaft 12 of the water jet pump P. Fairing vanes 14 are disposed behind the impeller 13. The impeller 13 is covered with a tubular pump casing 15 on the outer periphery thereof.

A water intake 16 is provided on a bottom surface of the hull 3 of the body 2. The water intake 16 is connected to the pump casing 15 through a water passage 17. A pump nozzle 18 is provided at a rear portion of the body 2 and is coupled to the pump casing 15. The pump nozzle 18 has a diameter decreasing rearward, and an outlet port 19 opens at a rear end thereof. A steering nozzle 20 is coupled to the outlet port 19 of the pump nozzle 18 such that the steering nozzle 20 is pivotable to the right or to the left.

Water outside the watercraft 1 is sucked from the water intake 16 on the bottom surface of the hull 3 and is fed to the water jet pump P through the water passage 17. Driven by the engine E, the water jet pump P causes the impeller 13 to rotate to pressurize and accelerate the water. The water is guided by the fairing vanes 14 and ejected rearward from the outlet port 19 of the pump nozzle 18 and through the steering nozzle 20. As the resulting reaction, the watercraft 1 obtains a propulsion force for propelling the body 2.

A bar-type steering handle 21 is disposed in front of the seat 6. A throttle lever 25 (see FIG. 2) is attached to a right grip portion of the handle 21 and is configured to be gripped with a right hand of the rider. A meter device 22 is provided in front of the handle 21. A center storage 23 is provided under the handle 21. The handle 21 is coupled to the steering nozzle 20 via a steering cable 36 (see FIG. 2). When the rider rotates the steering handle 21 clockwise or counterclockwise, the steering nozzle 20 is pivotable to the right or to the left, changing the direction of the water ejected from the steering nozzle 20 to the left or to the right. The handle 21 is rotated by the rider while the water jet pump P is ejecting the water rearward to generate a propulsion force for propelling the body 2 so that the direction of water ejected through the steering nozzle 20 is changed to the right or to the left. Correspondingly, the moving direction of the watercraft 1 is changed.

Figure 2:
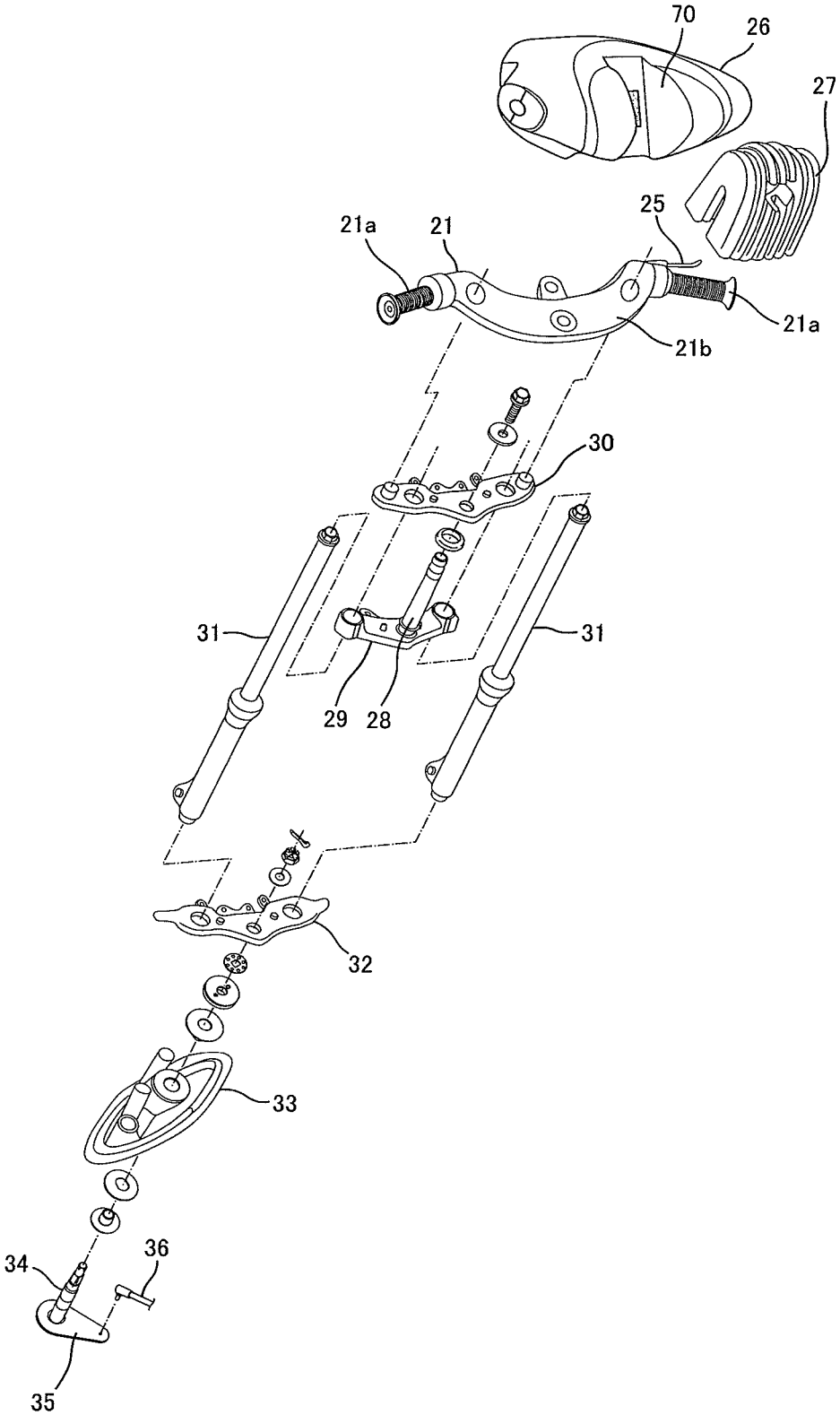
FIG. 2 is an exploded perspective view of a steering system of the personal watercraft of FIG. 1.

FIG. 2 is an exploded perspective view of a steering system of the personal watercraft 1 of FIG. 1. As shown in FIG. 2, the steering handle 21 includes a handle base portion 21*b* and a pair of grip portions 21*a* provided at right and left ends of the handle base portion 21*b*. The handle base portion 21*b* is covered with a handle pad 26. The handle pad 26 has a hollow shape and is made of elastic resin such as NBR rubber or EPDM rubber. In an inner space of the handle pad 26, a flexible load absorbing member 27, which is made of a foamed material or urethane, is disposed on an upper surface side of the handle base portion 21*b*.

The steering shaft 28 is held by an upper bracket 30 at an upper portion thereof and a holder 29 at a lower portion thereof. The upper bracket 30 is coupled to the handle 21. Upper end portions of shock absorbers 31 are coupled to the upper bracket 30. A lower bracket 32 is coupled to lower end portions of the shock absorbers 31. The shock absorbers 31 are disposed to extend at right and left sides of the steering shaft 28 along the direction in which the steering shaft 28 extends. The lower bracket 32 is rotatably coupled to a support member 33 fastened to the body 2 by a washer, bushing, and a nut. A rotational shaft 34 is provided to extend vertically on a steering plate 35 and is coupled to the lower bracket 32. One end of the steering cable 36 is coupled to the steering plate 35.

In such a configuration, when an axial load of the steering shaft 28 is applied to the steering handle 21, the shock absorbers 31 are extended or contracted, changing a distance between the upper bracket 30 and the lower bracket 32. This makes it possible to reduce a shock transferred from the steering handle 21 to the rider's arms and hence to reduce a fatigue of the rider's arms or shoulders. The steering shaft 28 is of a pipe-shape. A throttle cable (not shown) or a signal cable (not shown) is inserted into the steering shaft 28. Each of these cables is disposed to have an extra length so that they are not tense when the shock absorbers 31 are extended to their maximum length. The steering handle 21 may be tilted upward and downward.

Figure 3:
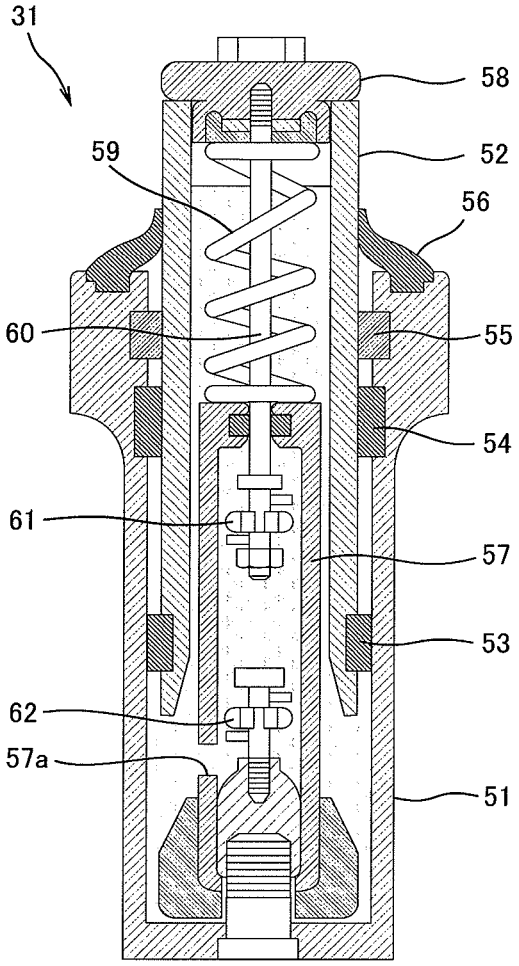
FIG. 3 is a cross-sectional view of a shock absorber of FIG. 2.

FIG. 3 is a cross-sectional view of the shock absorber 31 of FIG. 2. As shown in FIG. 3, the shock absorber 31 has a bottomed outer pipe 51. An inner pipe 52 having an upper opening closed with a cap 58 is slidably inserted into the outer pipe 51 via slide metals 53 and 54 and an oil seal 55 and a dust seal 56. Oil is stored in an inner space formed by the outer pipe 51 and the inner pipe 52. A cylinder 57 is accommodated in the inner space such that the cylinder 57 is fixed to a bottom wall of the outer pipe 51. A spring 59 is mounted between the cylinder 57 and a cap 58.

The cap 58 is provided with a shaft 60 protruding downward. The shaft 60 penetrates through the cylinder 57. A main valve 61 is provided at a lower end portion of the shaft 60 to be spaced slightly apart from an inner peripheral surface of the cylinder 57. A connecting hole 57*a* is formed on a side wall of a lower portion of the cylinder 57. A sub-valve 62 is provided inside the cylinder 57 such that the sub-valve 62 is spaced slightly apart from the inner peripheral surface of the cylinder 57 and is located slightly above the connecting hole 57*a*. In this structure, when a downward load is applied to the inner pipe 52, for example, the load is absorbed by the spring 59 and is attenuated by the resistance of the oil transferred to the main valve 61.

Figure 4:
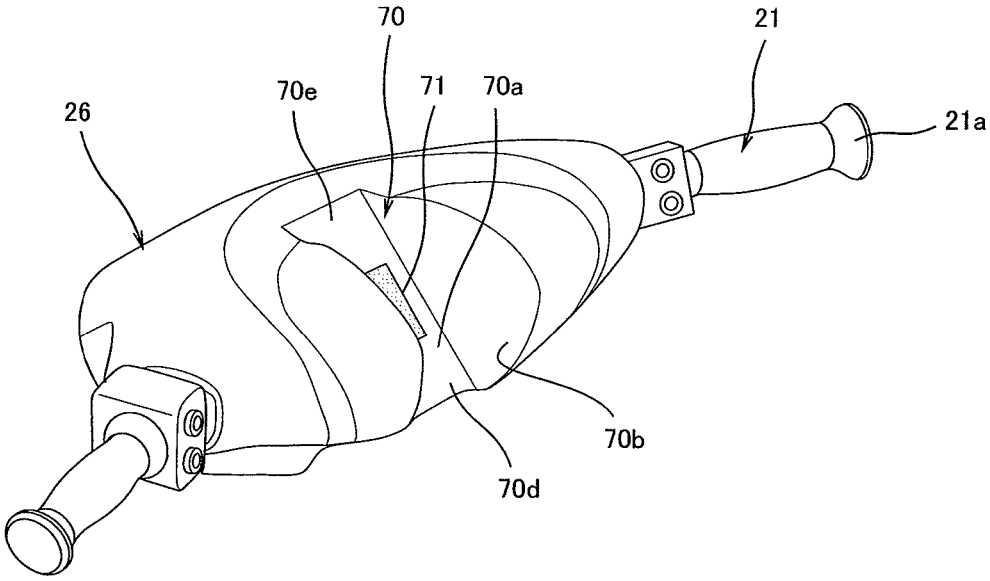
FIG. 4 is a perspective view of a handle and a handle pad in the personal watercraft of FIG. 1.
Figure 5:
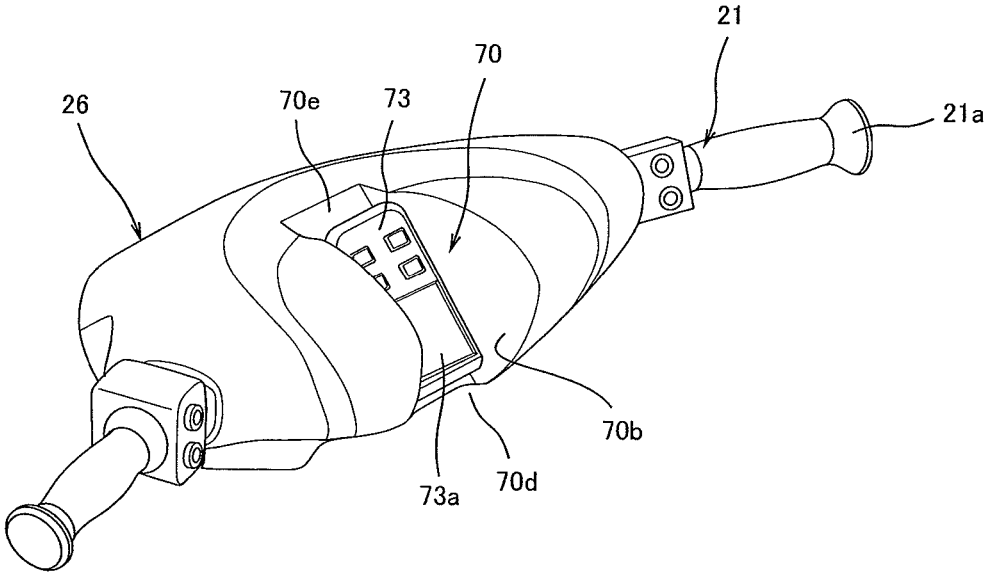
FIG. 5 is a perspective view showing a state where a portable GPS terminal is mounted to the handle pad of FIG. 4.
Figure 6:
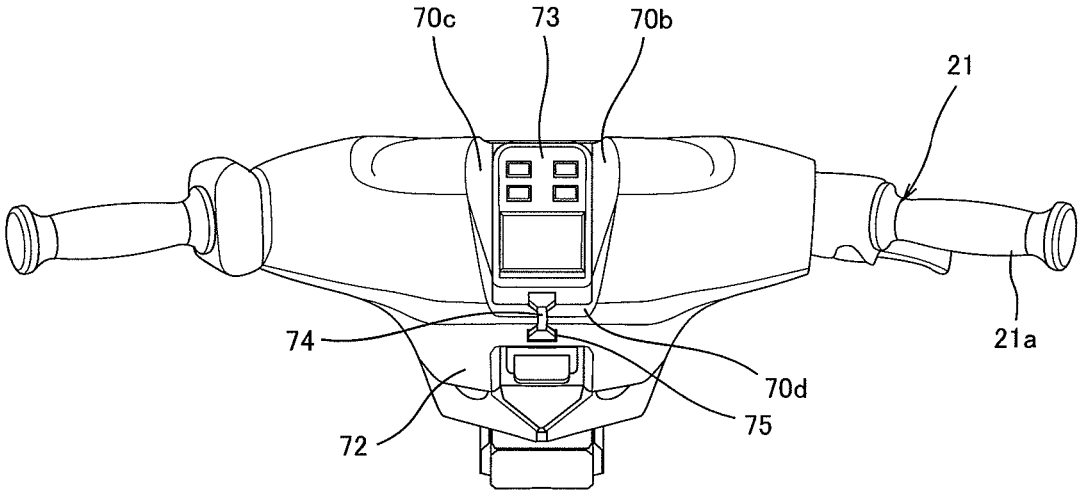
FIG. 6 is a rear view of FIG. 5.

FIG. 4 is a perspective view of the handle 21 and the handle pad 26 in the personal watercraft of FIG. 1. FIG. 5 is a perspective view showing a state where the portable GPS terminal 73 is mounted to the handle pad 26 of FIG. 4. FIG. 6 is a rear view of FIG. 5. As shown in FIG. 4, an accommodating concave portion 70 is formed on a surface of the handle pad 26 to accommodate the portable GPS terminal 73 which is a portable information device. The accommodating concave portion 70 is provided in a center section of the handle pad 26 in a rightward and leftward direction such that the concave portion 70 is opposite to the rider.

To be specific, the accommodating concave portion 70 includes a bottom wall portion 70*a*, and side wall portions 70*b* and 70*c* (see FIG. 6) extending vertically from right and left sides of the bottom wall portion 70*a*, and openings 70*d* and 70*e* which are configured to extend along the surface of the bottom wall portion 70*a* and in the direction perpendicular to the rightward and leftward direction. The side wall portions 70*b* and 70*c* protrude from the bottom wall portion 70*a* toward the rider in a circular-shape in a side view. The opening 70*d* is oriented to extend rearward and downward, while the opening 70*e* is oriented to extend forward and upward. A hook-and-loop fastener 71, which is a mounting portion, is provided on the bottom wall portion 70*a* and is configured to removably fasten the portable GPS terminal 73 to the bottom wall portion 70*a*.

As shown in FIG. 5, the portable GPS terminal 73 is accommodated in the accommodating concave portion 70 such that a display screen 73a faces upward, and a hook-and-loop fastener (not shown) attached on a rear surface of the portable GPS terminal 73 is joined to the hook-and-loop fastener 71 (see FIG. 4) of the bottom wall portion 70*a*. In this state, the portable GPS terminal 73 is entirely disposed inside the accommodating concave portion 70 of the handle pad 26 and does not protrude outward therefrom. So, the shock generated when, for example, the rider bumps against the handle pad 26 is effectively absorbed by the handle pad 26 and the rider can enjoy driving the watercraft 1 without being disturbed by the portable GPS terminal 73. In addition, since the portable GPS terminal 73 is detachably attachable to the accommodating concave portion 70, it can be utilized in situations other than driving of the watercraft 1. Furthermore, since the portable GPS terminal 73 owned by the user is accommodated in the accommodating concave portion 70, it is not necessary to equip a GPS device in the watercraft 1. Therefore, the number of components and a manufacturing cost can be reduced. Moreover, since the portable GPS terminal 73 is attached to the handle pad 26 instead of the center storage 26 located therebelow, the rider is able to see the portable GPS terminal 73 without significantly changing the rider's visual line during driving of the watercraft 1.

As shown in FIG. 6, an external connector 75 is provided on the housing 72 located under the handle pad 26. The portable GPS terminal 73 and the external connector 75 are configured to be coupled to each other via a communication cable 74. As the connector, a water-proof connector is desirably used.

Figure 7:
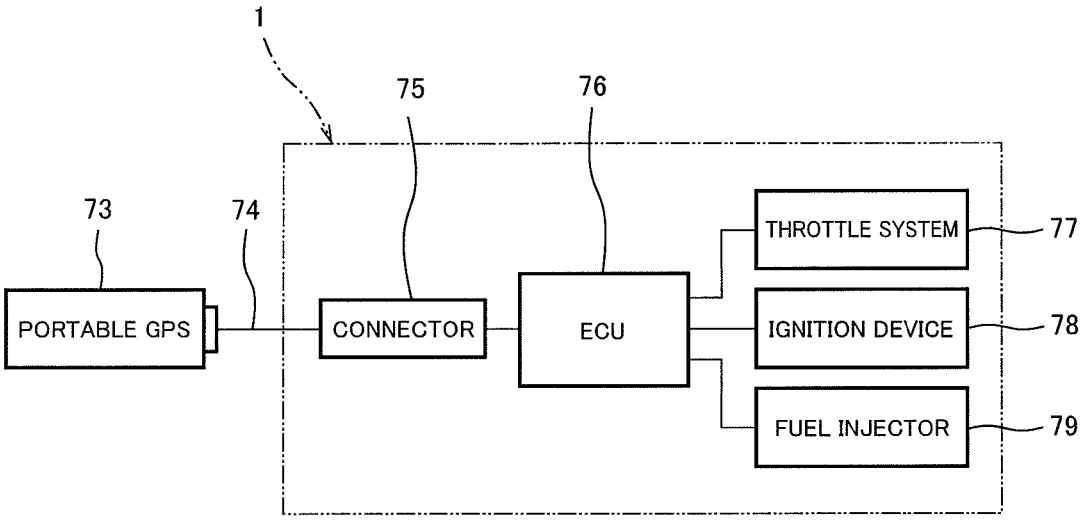
FIG. 7 is a block diagram of a personal watercraft of FIG. 1.

FIG. 7 is a block diagram of the personal watercraft 1 of FIG. 1. As shown in FIG. 7, the watercraft 1 includes the external connector 75 coupled to the portable GPS terminal 73 attached to the accommodating portion 70 via the communication cable 74, and an electronic control unit (e.g., ECU) 76 electrically connected to the external connector 75. A throttle system 77 configured to change an engine speed of the engine E (see FIG. 1), an ignition device 78, and a fuel injector 79 are communicatively coupled to the electronic control unit 76. In the present embodiment, the throttle system 77 is an electronic control throttle system which is configured to control a valve opening degree by the electronic control unit 76.

Figure 8:
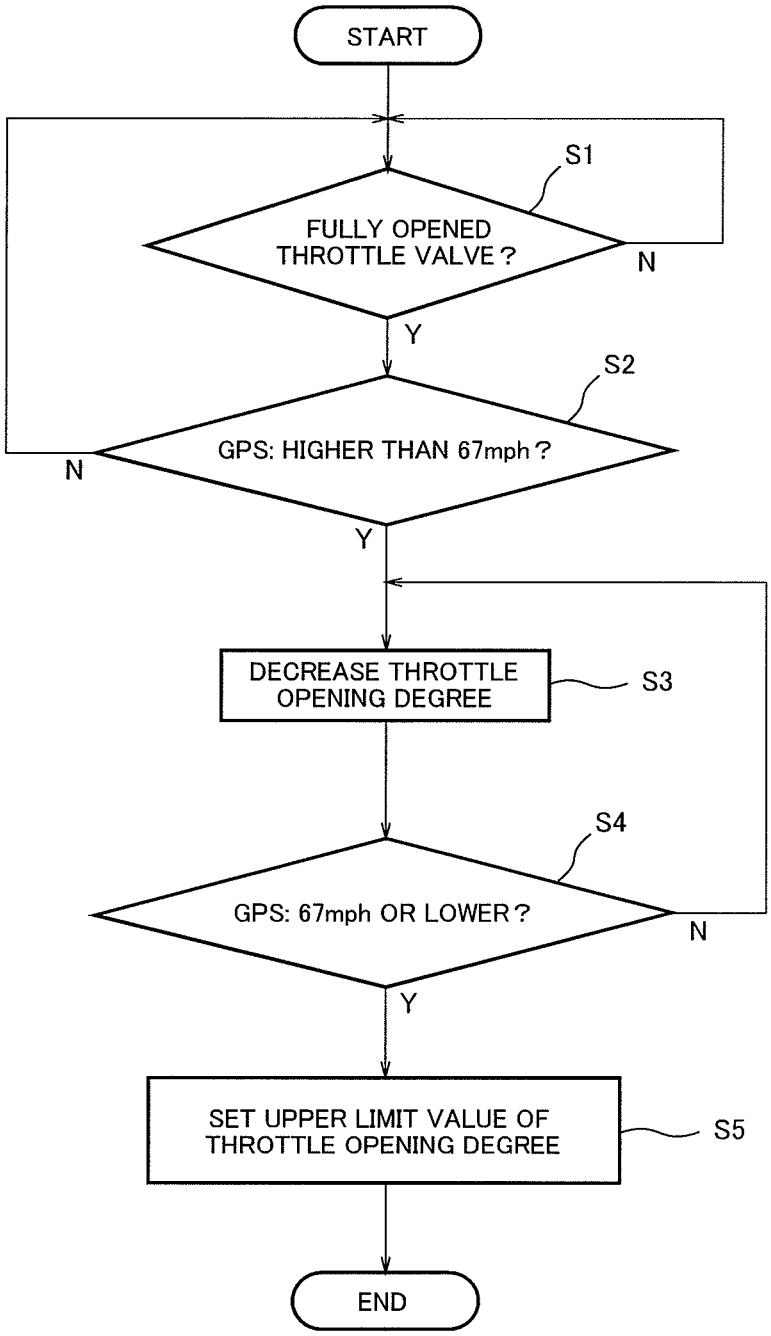
FIG. 8 is a flowchart of a control process executed by an electronic control unit of FIG. 7.
Figure 9:
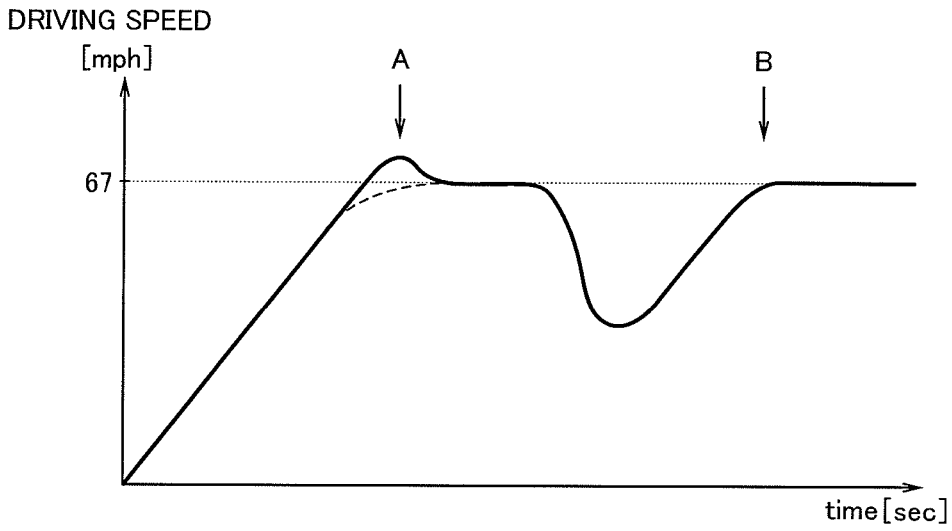
FIG. 9 is a graph showing a change in a driving speed under control of FIG. 8.

FIG. 8 is a flowchart of a control process executed by the electronic control unit 76 of FIG. 7. FIG. 9 is a graph showing a change in a driving speed under control of FIG. 8. In personal watercraft, the engine tends to generate a high driving power in winter season and a low driving power in summer season, because of change in air density due to temperature change. In addition, performance varies from personal watercraft to personal watercraft, because of mass production. Accordingly, as shown in FIG. 8, initial control is executed so that a maximum speed of the watercraft 1 is maintained constant.

Turning to FIG. 8, when the engine E starts, the electronic control unit 76 determines whether or not the rider has operated the throttle lever 25 (see FIG. 2) to fully open the throttle valve (step S1). If it is determined that the throttle valve is not fully opened (NO in step S1), step S1 is repeated. On the other hand, if it is determined that the throttle valve is fully opened (YES in step S1), the electronic control unit 76 calculates a driving speed of the watercraft 1 based on positional information of the watercraft 1 which is received from the portable GPS terminal 73, and determines whether or not the calculated driving speed is higher than a predetermined upper limit value, for example, 67 mph (Step S2).

If it is determined that the driving speed of the watercraft 1 is not higher than 67 mph (NO in step S2), the process returns to step S1. On the other hand, if it is determined that the driving speed is higher than 67 mph as indicated by A part in FIG. 9, then the electronic control unit 76 decreases the throttle opening degree to decrease the engine speed (step S3). Then, the electronic control unit 76 determines whether or not the driving speed calculated based on the positional information from the portable GPS terminal 73 is 67 mph or lower (step S4). If it is determined that the driving speed is higher than 67 mph (NO in step S4), the process returns to step S3 in which the engine speed continues to be decreased. On the other hand, if it is determined the driving speed is 67 mph or lower (YES in step S4), the electronic control unit 76 causes the value of the throttle opening degree at that point of time to be stored in the memory within the electronic control unit 76 as the upper limit value (step S5).

As a result of the above control process, the driving speed does not thereafter become higher than 67 mph as indicated by B part shown in FIG. 9, even when the throttle valve continues to be fully opened. That is, since an appropriate upper limit value is set in the throttle opening degree in step S5 in FIG. 8, the maximum speed of the watercraft 1 can be kept constant without feedback control. The control process in FIG. 8 is executed every time the engine E is re-started.

In the present embodiment, the GPS is utilized to detect the driving speed of the watercraft 1. In general, a flow rate meter is used to mechanically measure a speed of water flowing under the bottom of the body. But, a correct value cannot in some cases be obtained using the flow rate meter, when for example, the body of the watercraft 1 is jumping, or seaweed or other objects contained in the water are stuck in the flow rate meter. Thus, in the present embodiment, a correct driving speed that should be used in maximum speed control is obtained using the GPS.

In the present embodiment, the upper limit value of the throttle opening degree is stored in the memory so that the upper limit value of the engine speed is determined and the maximum value of the driving speed is maintained constant. Alternatively, in Step S5 of FIG. 8, the upper limit value of the engine speed may be stored in the memory so that the maximum value of the driving speed is kept constant. In the present embodiment, the throttle opening degree is controlled to control the engine speed. Alternatively, to control the engine speed, ignition timing of the ignition device 78 may be retarded or the amount of fuel to be injected from the fuel injector 79 may be controlled.

(Embodiment 2)

Figure 10:
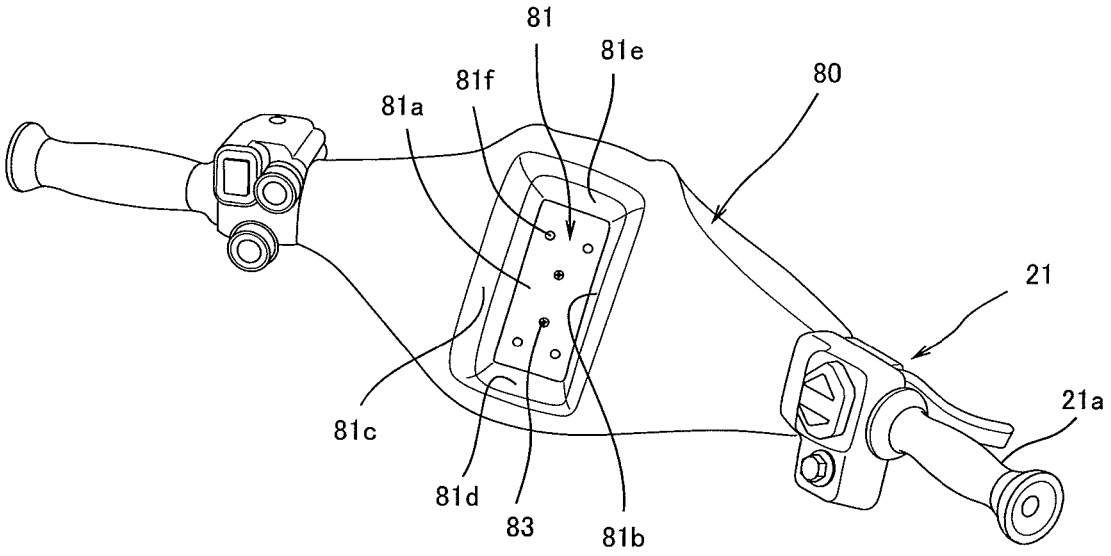
FIG. 10 is a perspective view of a handle and a handle pad in a personal watercraft according to a second embodiment of the present invention.

FIG. 10 is a perspective view of the handle 21 and a handle pad 80 in a personal watercraft according to a second embodiment of the present invention. Turning to FIG. 10, the handle pad 80 of the present embodiment is provided with an accommodating concave portion 81 on a surface thereof to accommodate a portable GPS terminal 85 (see FIG. 11). The accommodating concave portion 81 is provided in a center section in the rightward and leftward direction such that the concave portion 81 is opposite to the rider. To be specific, the accommodating concave portion 81 includes a bottom wall portion 81*a* having a rectangular shape in a plan view, and four side wall portions 81*b* to 81*e* extending vertically from the periphery of the bottom wall portion 81*a* so as to surround the portable GPS terminal 85.

Figure 11:
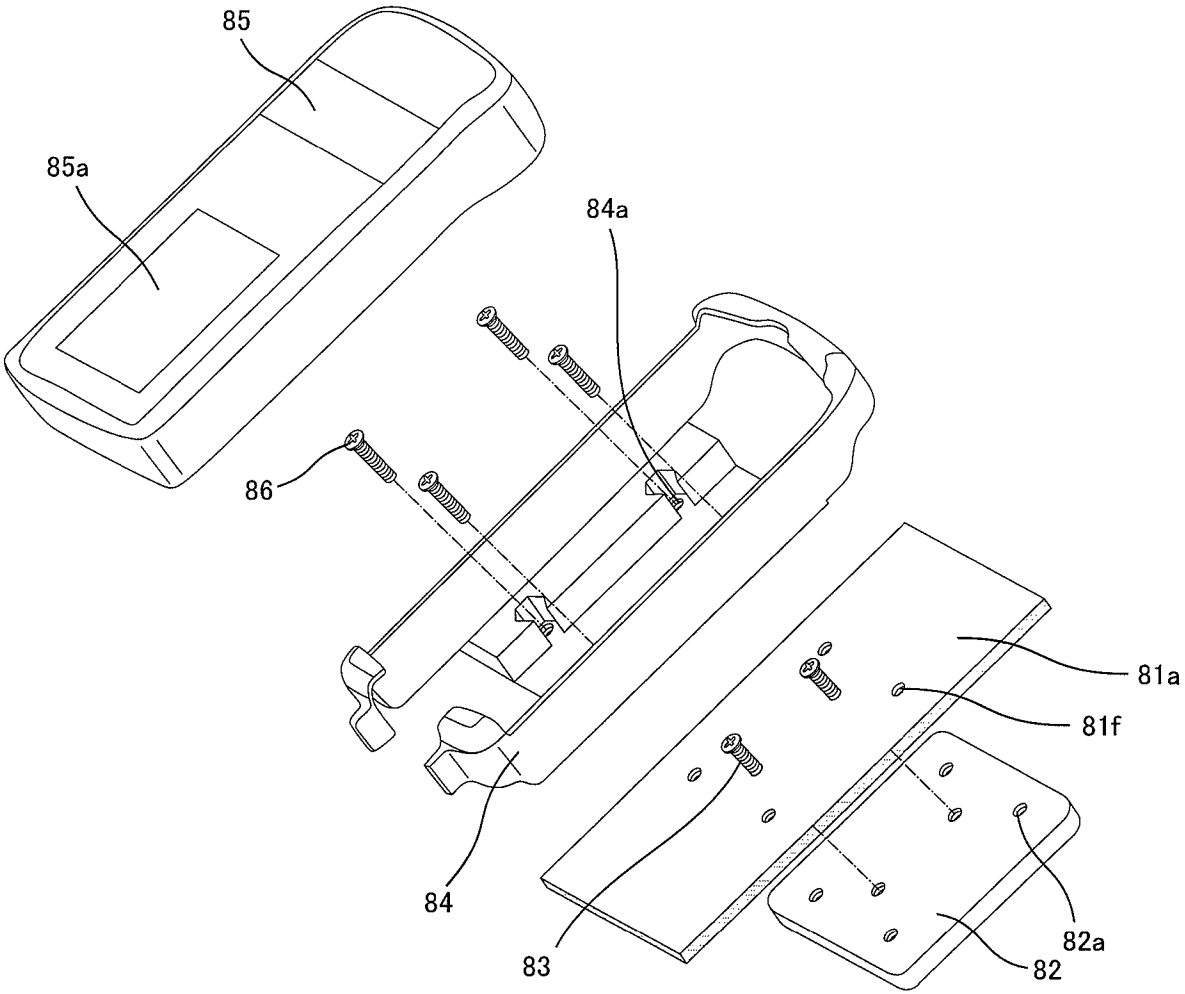
FIG. 11 is an exploded perspective view showing a procedure for mounting a portable GPS terminal to the handle pad of FIG. 10.

FIG. 11 is an exploded perspective view showing a procedure for mounting the portable GPS terminal 85 to the handle pad 80 of FIG. 10. Turning to FIGS. 10 and 11, a back plate 82 which is formed of a metal plate is provided on a lower surface (surface of an inner space side of the handle pad 80) of a bottom wall portion 81*a* of the handle pad 80. The bottom wall portion 81*a* and the back plate 82 are fastened to each other by threaded members 83. Threaded holes 81*f* are provided on the bottom wall portion 81*a* and threaded holes 82*a* are provided on the back plate 82 to fasten thereto a GPS case 84 which is a mounting portion.

The threaded holes 81*f* and the threaded holes 82*a* serve as a mounting portion. The GPS case 84 is formed of a resin frame for retaining the portable GPS terminal 85. The GPS case 84 is provided with threaded holes 84*a* connected to the threaded holes 81*f* of the bottom wall portion 81*a* and the threaded holes 82*a* of the back plate 82. Whereas the user must purchase the portable GPS terminal 85 and the GPS case 84 separately from the watercraft 1, the GPS case 84 may be equipped in the watercraft 1 as the mounting portion for the portable GPS terminal 85.

Figure 12:
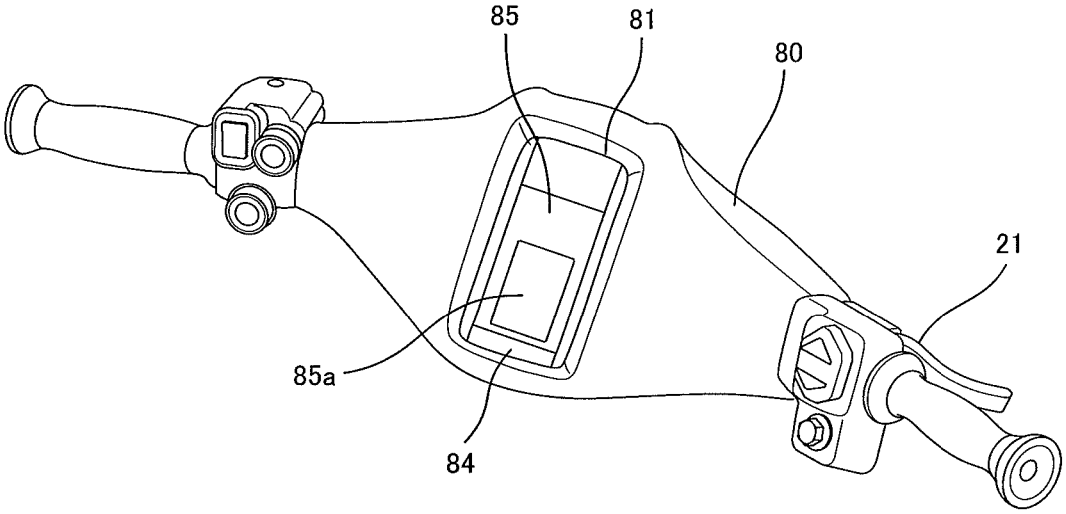
FIG. 12 is a perspective view showing a configuration in which the portable GPS terminal is mounted to the handle pad of FIG. 10.

FIG. 12 is a perspective view showing a configuration in which the portable GPS terminal 85 is mounted to the handle pad 80 of FIG. 10. As shown in FIGS. 11 and 12, the threaded members 86 are threadedly engaged with the threaded holes 84*a*, 81*f*, and 82*a* to fasten the GPS case 84 to the bottom wall portion 81*a* and the back plate 82. Then, the portable GPS terminal 85 is attached to the GPS case 84 such that a display screen 85*a* faces upward. Thus, the portable GPS terminal 85 is accommodated into the accommodating concave portion 81 such that the terminal 85 is disposed inside the concave portion 81 of the handle pad 80 and does not protrude outside therefrom. A water-drain hole may be provided on a wall forming the accommodating concave portion 81.

(Embodiment 3)

Figure 13:
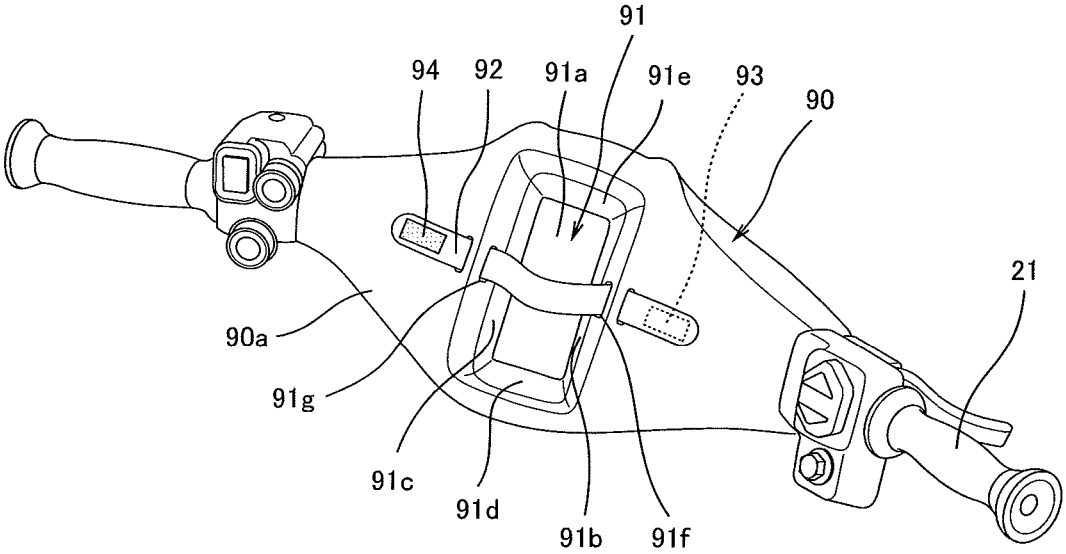
FIG. 13 is a perspective view of a handle and a handle pad of the personal watercraft according to a third embodiment of the present invention.

FIG. 13 is a perspective view of the handle 21 and a handle pad 90 according to a third embodiment of the present invention. Turning to FIG. 13, the handle pad 90 is provided with an accommodating concave portion 91 on a surface 90*a* thereof to accommodate the portable GPS terminal 85 (see FIG. 14). To be specific, the accommodating concave portion 91 includes a bottom wall portion 91*a* having a rectangular shape in a plan view, and four side wall portions 91*b* to 91*e* extending vertically from the periphery of the bottom wall portion 91*a*, to be precise, from front, rear, right, and left sides of the bottom wall portion 91*a* so as to surround the portable GPS terminal 85. The handle pad 90 is provided with band through holes 91*f* and 91*g* penetrating from the right side wall portion 91*b* and the left side wall portion 91*c* to the surface 90*a*. The band through holes 91*f* and 91*g* serve as a band mounting portion. A flexible band 92 having hook-and-loop fasteners 93 and 94 at both ends thereof is inserted through the band through holes 91*f* and 91*g*.

Figure 14:
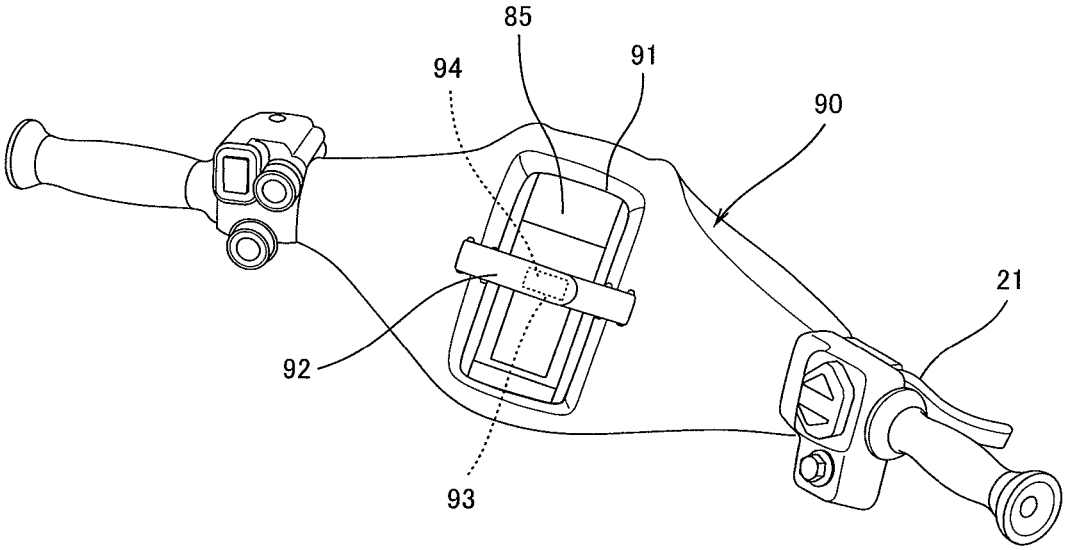
FIG. 14 is a perspective view showing a configuration in which the portable GPS terminal is mounted to the handle pad of FIG. 13.

FIG. 14 is a perspective view showing a configuration in which the portable GPS terminal 85 is attached to the handle pad 90 of FIG. 13. As shown in FIGS. 13 and 14, the portable GPS terminal 85 is accommodated into the accommodating concave portion 91 with the band 92 inserted through the band through holes 91*f* and 91*g*, the band 92 is wound around the portable GPS terminal 85, and the hook-and-loop fasteners 93 and 94 fasten the portable GPS terminal 85. Thus, the portable GPS terminal 85 is accommodated into the accommodating concave portion 91 such that the terminal 85 is entirely disposed inside the concave portion 91 of the handle pad 90 and does not protrude outside therefrom.

Alternatively, a water-proof cover may be provided on the accommodating concave portions 70, 81, and 91 in the above described embodiments. In a further alternative, a portable information device such as a cellular phone may be accommodated into the accommodating concave portion, instead of the portable GPS terminal.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

We claim:

1. A personal watercraft comprising:

a hull;

a deck covering the hull;

an engine disposed in an inner space defined by the hull and the deck;

a water jet pump driven by the engine and causing an impeller to rotate to obtain a propulsion force;

a handle having a pair of right and left grip portions;

a handle pad configured to cover a region of the handle, the region being located between the pair of grip portions, the handle pad having a hollow shape and being made of elastic resin;

a load absorbing member disposed in an inner space of the handle pad so that the handle pad is configured to effectively absorb a shock generated when a rider bumps against the handle pad during driving of the watercraft;

an electronic control unit configured to control the engine; and an external connector configured to communicatively couple the electronic control unit to a portable information device accommodated in an accommodating concave portion and configured to receive and transmit GPS based signals from the portable information device to the electronic control unit;

wherein the handle pad is provided on an upper surface thereof with the accommodating concave portion configured to be opposite to the rider and accommodate therein the portable information device detachably such that the portable information device is entirely disposed inside the concave portion of the handle pad and does not protrude outside therefrom; and the electronic control unit calculates a driving speed from the GPS based signals which is received via the external connector and controls an engine speed of the engine such that the driving speed is not higher than a predetermined upper limit value.

2. The personal watercraft according to claim 1, wherein the accommodating concave portion is provided with a mounting portion configured to detachably fasten the portable information device.

3. The personal watercraft according to claim 2, wherein the mounting portion includes a threaded hole.

4. The personal watercraft according to claim 2, wherein the mounting portion includes a case fastened to the handle pad.

5. The personal watercraft according to claim 2, wherein the mounting portion includes a hook-and-loop fastener.

6. The personal watercraft according to claim 2, wherein the mounting portion includes a band mounting portion.

7. The personal watercraft according to claim 1;

wherein the accommodating concave portion has a bottom wall portion, and side wall portions extending from right and left sides of the bottom wall portion; and wherein the accommodating concave portion is configured to open in a normal line direction of a surface of the bottom wall portion and to open in a direction perpendicular to the normal line direction which is perpendicular to a rightward and leftward direction.

8. The personal watercraft according to claim 1, wherein the accommodating concave portion has a bottom wall portion, and side wall portions extending substantially vertically from a periphery of the bottom wall portion so as to surround the portable information device.

9. The personal watercraft according to claim 1, further comprising a shock absorber provided between the handle and a body of the personal watercraft.

* * * * *